US005095988A

United States Patent [19]

Bode

[11] Patent Number: 5,095,988

[45] Date of Patent: Mar. 17, 1992

[54] PLUG INJECTION METHOD AND APPARATUS

[76] Inventor: Robert E. Bode, 12500 Melville, No. 109A, Montgomery, Tex. 77356

[21] Appl. No.: 657,329

[22] Filed: Feb. 19, 1991

Related U.S. Application Data

[63] Continuation-in-part of Ser. No. 542,740, Jun. 22, 1990, abandoned, which is a continuation-in-part of Ser. No. 437,458, Nov. 15, 1989, Pat. No. 5,004,048.

[51] Int. Cl.[5] ..... E21B 33/068; E21B 33/076; E21B 33/16

[52] U.S. Cl. ..... 166/291; 166/70; 166/156; 166/238; 166/383; 15/104.062; 137/268

[58] Field of Search ..... 166/291, 238, 237, 70, 166/155, 193, 156, 383; 15/104.062; 137/268

[56] References Cited

U.S. PATENT DOCUMENTS

| | | | |
|---|---|---|---|
| 2,575,105 | 11/1961 | Hart et al. | 166/237 |
| 2,664,163 | 12/1953 | Schnitter | 166/70 X |
| 2,751,024 | 6/1956 | Moosman | 166/237 |
| 3,028,996 | 4/1962 | Ellett | 15/104.062 |
| 3,616,850 | 11/1971 | Scott | 166/155 |
| 3,635,288 | 1/1972 | Lebourg | 166/291 X |
| 4,427,065 | 1/1984 | Watson | 166/291 X |
| 4,624,312 | 11/1926 | McMullin | 166/155 |
| 4,907,649 | 3/1990 | Bode | 166/70 |
| 4,917,184 | 4/1990 | Freeman et al. | 166/285 |

*Primary Examiner*—Stephen J. Novosad

[57] ABSTRACT

In accordance with illustrative embodiments of the present invention, a ball injecting apparatus for use in launching cementing plugs into a well casing includes a tubular body having an inlet port and one or more cylinders on the sides thereof adapted to be loaded with the balls, gates on the cylinders to prevent and permit injections of the balls, drive members extending into the upper and lower ends of the body and being rotatable relative thereto, and a sleeve slidably splined to the upper drive member and movable downward in the body in response to fluid pressure to transmit rotation of the upper drive member to the lower drive member. A set of uniquely arranged upper and lower plug assemblies are releasable attached to one another and are arranged to be sequentially released in response to seating of a ball, bomb or a dart therein.

29 Claims, 6 Drawing Sheets

PLUG INJECTION METHOD AND APPARATUS

RELATED APPLICATION

This application is a continuation-in-part of application Ser. No. 542,740 filed June 22, 1990, now abandoned, which was a continuation-in-part of application Ser. No. 437,458 filed Nov. 15, 1989, now U.S. Pat. No. 5,004,048.

FIELD OF THE INVENTION

This invention relates generally to the cementing of casing in oil and gas wells by the use of cementing plugs, and specifically to new and improved plug launching and ball or dart injection systems that are designed to selectively release one or more unique cement plugs into the well casing ahead of or behind a column of cement slurry to isolate the cement from other well fluids.

BACKGROUND OF THE INVENTION

To cement a casing in a well bore, the volume of cement slurry that is needed is calculated taking into account the dimensional characteristics of the casing and the borehole, the depth of the uppermost float valve where a displacement plug is expected to seat and seal, and the overall volumetric efficiency of the displacement system including the pump, valve, piping and the like. If the displacement plug does not in fact reach the seat when the calculated total displacement volume has been pumped, the typical procedure is to stop at this point for fear of overdisplacing the cement, that is, displacing all of it outside the casing. Of course overdisplacement creates a problem situation that drilling supervisors seek to avoid.

However being overly cautions respecting overdisplacement sometimes results in underdisplacement where a large volume of cement is left inside the casing. When the cement hardens, a lengthy column remains that must be drilled out, which is a time consuming and expensive process, as is the repair to the well when of an overdisplacement has occurred.

The use of cementing plugs is known. Prior systems are perhaps best described in U.S. Pat. No. 4,427,065 issued to James S. Watson. This patent discloses a cylindrical cementing plug container assembly which is loaded with one or more cementing plugs stacked vertically one above the other. The cementing plug assembly is held within the housing by mechanical release devices. The release devices are separately and remotely actuated, and when a release device is activated, a plug holder is moved out of the path of a plug so that it is pulled or pushed by a combination of fluid flow, vortex action and gravity into the fluid stream where it is caught up in the moving fluid and pumped downhole. However, the Watson device projects a significant distance above the casing which necessitates much longer elevator bails than would otherwise be required. Furthermore, if it is desired to launch more than two cementing plugs, either a separate plug container that projects even further above the casing must be fabricated, or some means provided to connect the containers in series. If this is not done, the reference device provides no significant safety over earlier methods also described in U.S. Pat. No. 4,427,065) of removing and replacing a dome each time a plug is inserted, which is time consuming and expensive process that creates hazardous working conditions. Moreover, each of the various casing sizes requires use of a different housing assembly.

An object on the present invention is to provide a new and improved plug launching and monitoring system that prevents overdisplacement or underdisplacement of cement slurry during a casing cementing job. Another object of the present invention is to provide a new and improved plug monitoring system that enables reliable determination of true volumetric efficiency of the displacing means while cement displacement is in progress.

SUMMARY ON THE INVENTION

These and other objects are attained in accordance with the concepts of the present invention through the provision of a system that includes a first cementing plug which optionally may be used ahead of a chemical spacer fluid and which insures a minimum amount of interference with a cement slurry and a minimal amount of contamination. The first plug and the spacer fluid, if used, are followed by a second plug which wipes the drilling fluid from the walls of the casing ahead of the column of cement slurry. A top cementing plug is released on command, and prevents contamination or channeling of the cement with and by the drilling fluids which are used to displace the cement.

A plug launching apparatus in accordance with present invention selectively launches one or more cementing plugs at desired intervals and includes a mandrel assembly which is suspended inside the casing below the upper end thereof. The mandrel assembly forms the central bodies of one or more cementing plugs which are releasably coupled, for example by shear rings having different strengths. A valve seat is mounted in each body and is arranged to receive a pick-up ball that is sized to be stopped by the seat. An injection manifold upstream of the mandrel assembly, which can be skid mounted, is provided with injection cylinders that are each fitted with a spring-loaded piston. Each cylinder is loaded with a pick-up ball which is held by the end portion of a plunger located in another cylinder and driven by a spring-loaded piston. Each pick-up ball is sized for cooperation with a seat in a respective cement plug body in a manner such that the pick-up ball for the lower plug is slightly smaller in diameter than the pick-up ball for the upper plug. The lower plug is launched when its pick-up ball seats and a pressure differential developed which shears the lower pin, and the upper plug is released likewise so that the plugs define the upper and lower ends of the cement columns.

The present invention further provides for a fail-safe, positive mechanical indication of the injection of each pick-up ball, as well as another indication of the launching of each plug. The invention thereby provides a highly adaptable, efficient and inexpensive means of injecting one or more cementing plugs which can be used in various sizes of casing, and which can be used for both surface plug launching or downhole plug launching. The present invention also is directed to new and improved ball or dart launching systems which can be suspended below the rig elevators by using a drill pipe handling sub that is mated thereto. The system allows suspension of the pipe string in either rotating or non-rotating operations. Means also are provided for coupling upper and lower plugs in various unique ways.

BRIEF DESCRIPTION OF DRAWINGS

The present invention has other objects, features and advantages which will become more clearly apparent in connection with the following detailed description of preferred embodiments, taken in conjunction with the appended drawings, in which.

DETAILED DESCRIPTION OF PREFERRED EMBODIMENTS

Figure 1:
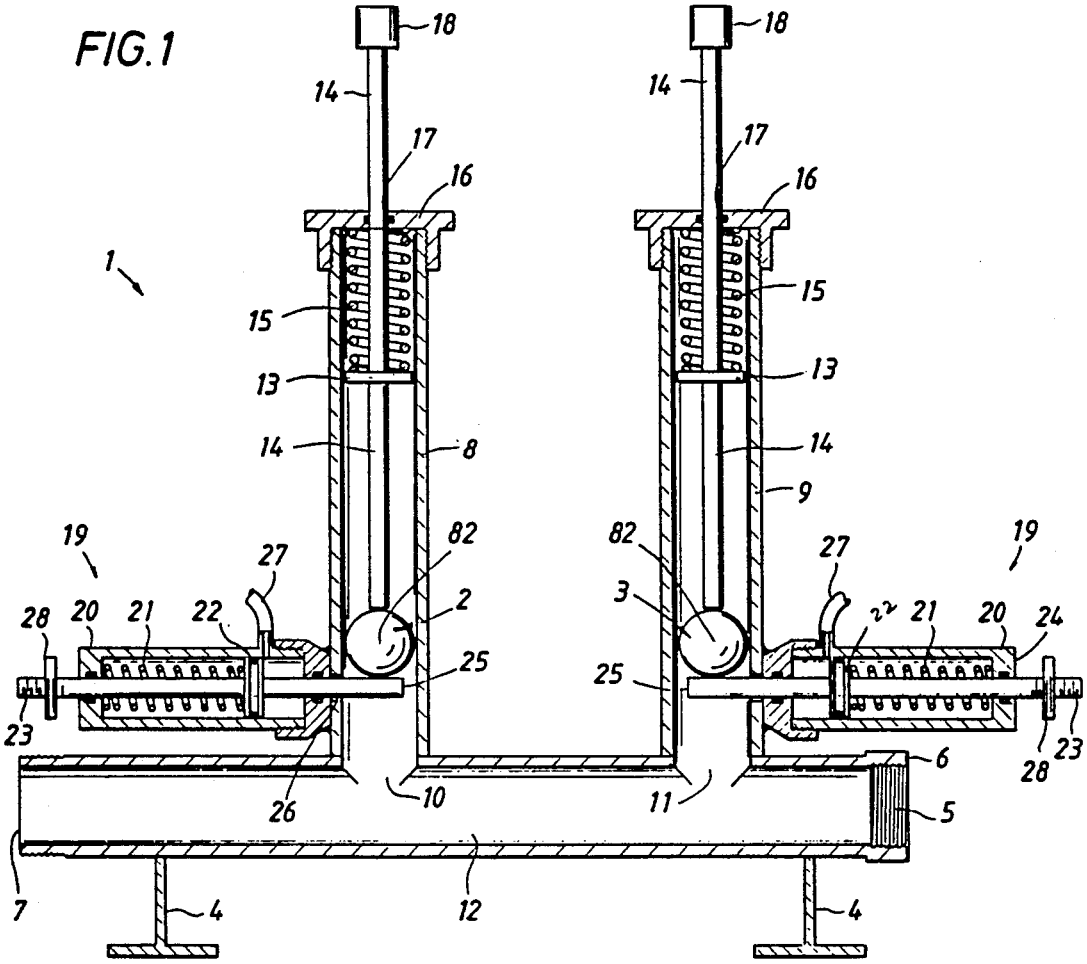
FIG. 1 is a cross-section through the surface injection manifold of the present invention.

With reference to FIG. 1, a surface injection manifold 1 is adapted to launch two pick-up balls 2 and 3, although more than two can be used depending upon the number of displacement plugs that are to be launched. The surface injection manifold 1 may be skid mounted on a frame 4 which is placed on the rig floor. The inlet end 5 of the injection manifold is provided with connection means such as threads 6 which are coupled by a single chicksan high pressure hose to a cement hopper or manifold (not shown). The exit end 7 is connected to the inlet 35 of the casing at the surface, or to a sub sea launching system, by another high pressure hose (not shown). The pick-up balls 2 and 3 are placed within the respective bores of cylindrical housings 8 and 9. Openings 10 and 11 communicate the respective housing bores with the interior flow passage 12 of the body of the injection manifold 1. A piston head 13 is positioned within each of the housings 8 and 9 and is mounted on a rod 14 which extends from the piston in both directions. In the loaded position shown in FIG. 1, the lower end of each rod 14 rests against the upper surface of a respective pick-up ball 2, 3 and the upper portion of the rod extends through the center of a compressed coil spring 15 and through a suitable seal ring 17 in a cap 16 and then projects upwardly there beyond. As an example, a spring capable of applying about 50 psi should be sufficient to launch a pick-up ball, but much higher spring forces are possible. If desired, additional seal means can be mounted on the pistons 13 so that hydraulic line connections to the bores of the housings 8 and 9 above and below the pistons 13 can be coupled to the rig hydraulic system to apply downward force in order to inject the pick-up balls into the passage 12. A stop 18 can be attached to the uppermost end of each rod 14 to limit its downward movement.

A ball retaining and releasing apparatus indicated generally at 19 is mounted in a suitable manner to the side of each housing 8, 9. Each apparatus 19 includes a cylindrical housing 20 which receives a coil spring 21 that pushes against a piston 22 which is mounted on an axially extending rod 23 in order to bias it inward. The outer portion of each rod 23 passes through a wiper in the outer end of its cylinder 24, and the inner portions extends through a seal ring in the inner end of the housing and into the respective interiors of the cylinders 8 and 9 at a location that is closely adjacent the openings 10 and 11. When the springs 21 are fully extended, the projecting or stop end 25 of each rod 23 projects through a hole in the cylinder wall in such a manner that it prevents downward movement of a pick-up ball 2, 3 through an opening 10, 11 into the main bore 12 of the injection manifold.

Each retaining and releasing apparatus 19 is provided with an inlet 27 that provides a means for introducing air under pressure into the cylinder 20 on the inner side of the piston 22, so that as air pressure is increased the spring 21 is compressed. This caused the projecting end portions 25 of the rods 23 to shift outward and be withdraw from the bores of the housings. This in turn permits the pick-up ball to pass into the manifold bore 12 at a desired time, and allows the ball to be injected in a desired sequence. Stops 28 on the outer end portion of each rod 23 limit inward movement. If desired, means such as a suitable releasable latch can be provided to positively lock the rods 23 in their inner or loaded positions until a ball is to be injected.

Figure 2:
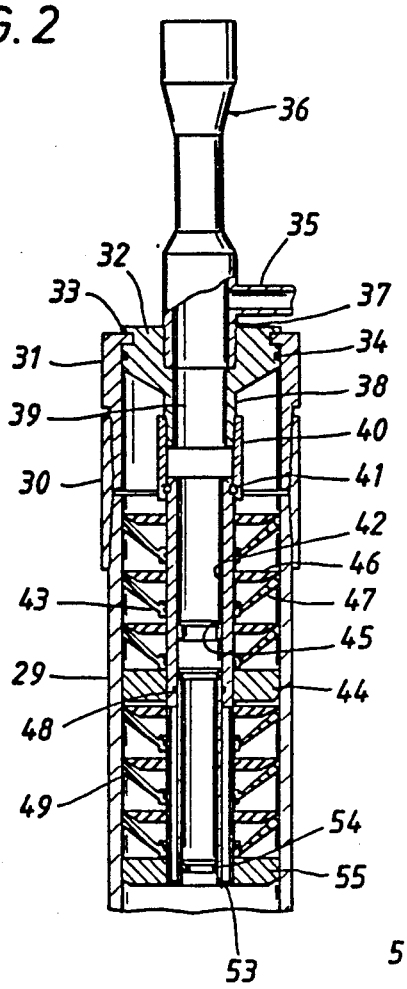
FIG. 2 is a cross-section of an embodiment of a plug launching system that is suspended at or near the upper end of the casing.

Referring now to FIG. 2, there is illustrated in cross-section a cement plug launching system that preferably is suspended at or near the surface opening of the casing to be cemented. As previously mentioned, some of the advantages of the present invention are that there is no requirement for a housing that extends or projects a great distance above the casing, and that the launching system can be simply and quickly adapted for use with different sizes of casing. The casing 29 projects only a short distance above a casing hanger (not shown) at the surface. A standard casing collar 30 is threaded to the upper end of the casing, and an adapter 31, which can be sized and arranged to adapt to any desired size and thread configuration of casing, is threaded to the collar 30. An inner adapter ring 32 of a standard size is fixed to the adapter 31 by a lock shoulder 33 which can be in the form of a nut which is threadedly attached to the upper portion of the adapter, and which screws down to tighten the shoulder 33 against the casing adaptor 32. A seal 34, which for example can be an o-ring or a polypack seal, is provided to prevent fluid leakage. An inlet means 35, which is attached by a suitable hose to the outlet 7 of the injection manifold (FIG. 1), is mounted on the side of a handling sub 36 that is threaded into the adapter 32 and by which the apparatus can be picked up and make up to the well pipe. A magnetic sensor 37, the purposes of which will be described in more detail below, can be mounted immediately below the inlet 35.

The inner adapter 32 comprises an upper cylindrical portion, an intermediate conical portion tapering downward and inward, and a lower tubular portion 38 which suspends the various components of a cement plug assembly. An internal passage 39 communicates with the inlet 35, the injection manifold bore 12, and any attached cementing manifold (not shown). A sleeve 40 is threadedly attached to the lower portion 38 of the adaptor 32, and a shear ring 41 releasably attaches a top plug mandrel 42 thereto. Although the present invention can use conventional cement displacement plugs, it is preferred to use the new and improved displacement plugs described and claimed in my U.S. application Ser. No. 339,483 which is expressly incorporated herein by reference.

Figure 4:
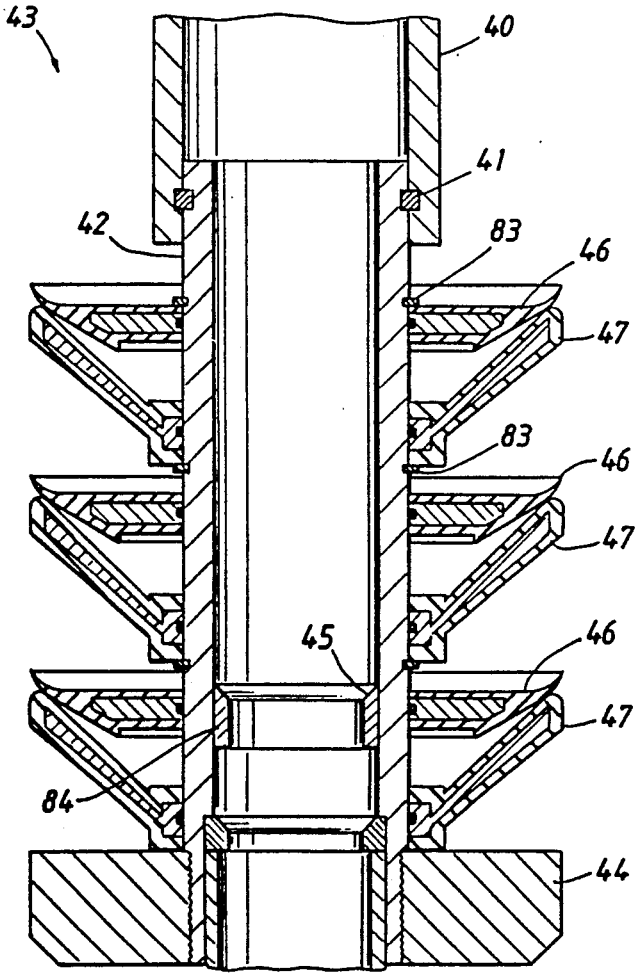
FIG. 4 is a cross-sectional view of an upper displacement plug.

The top plug assembly 43 is illustrated in further detail in FIG. 4 and includes a centralizer and drive plate 44 that is threaded to the lower end of the mandrel 42. An upper ball stop ring 45 is fixed within the mandrel 42 as shown, and the shear ring 41 releasably connects the upper end of the mandrel to the sleeve 40. A plurality of pairs of upper and lower cup-type seal assemblies 46 and 47 are mounted for limited axial movement on the exterior of the mandrel 42 relative to stop rings 83. As discussed in the above-mentioned application, each assembly includes a pressure-responsive cup means and a back-up means by which the plug is advanced through the casing in response to pressure.

Figure 5:
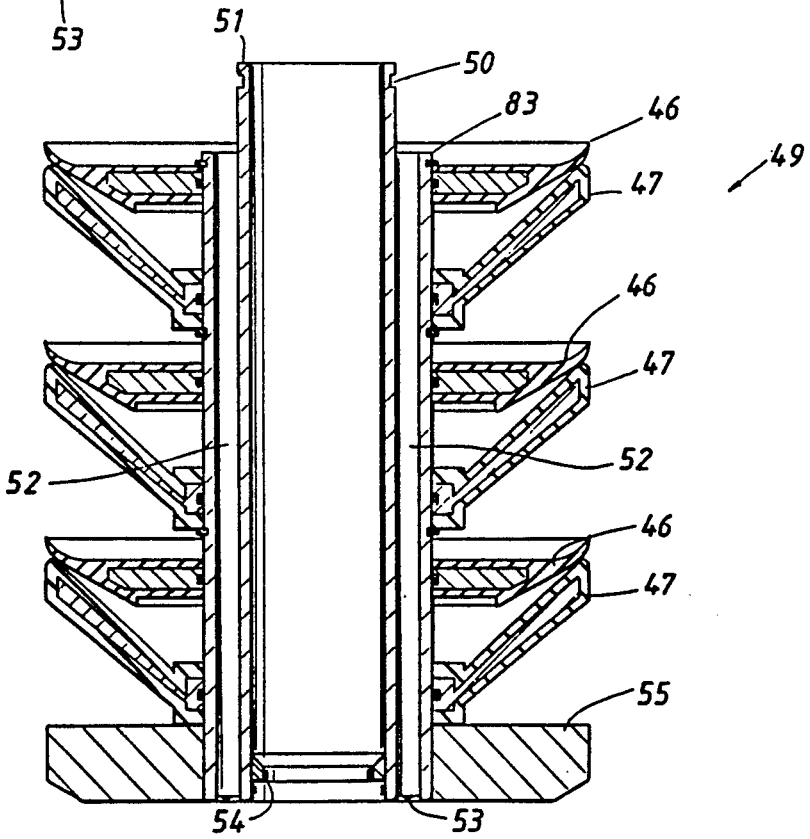
FIG. 5 is a cross-sectional view of a lower displacement plug.

The lower displacement plug assembly 49 is releasably attached to the upper assembly 43 by another shear ring 48 as shown in FIGS. 2 and 5. The shear ring 48 fits in an external annular groove 50 near the upper end of the bottom plug mandrel 51. One or more axially extending circulation passages 52 are provided along the sides of the mandrel 51, and the lower end of each passage 52 is closed by a rupture disc valve 53 that will open at a selected pressure differential. A lower ball seat ring 54 is mounted near the lower end of the mandrel 51, and has a smaller inner diameter then the upper ring 45. A centralizer plate 55 is attached to the bottom of the mandrel 51. Additional sets of upper and lower pressure operated cup seal assemblies 46, 47 are mounted on the exterior of the mandrel 51.

Figure 3:
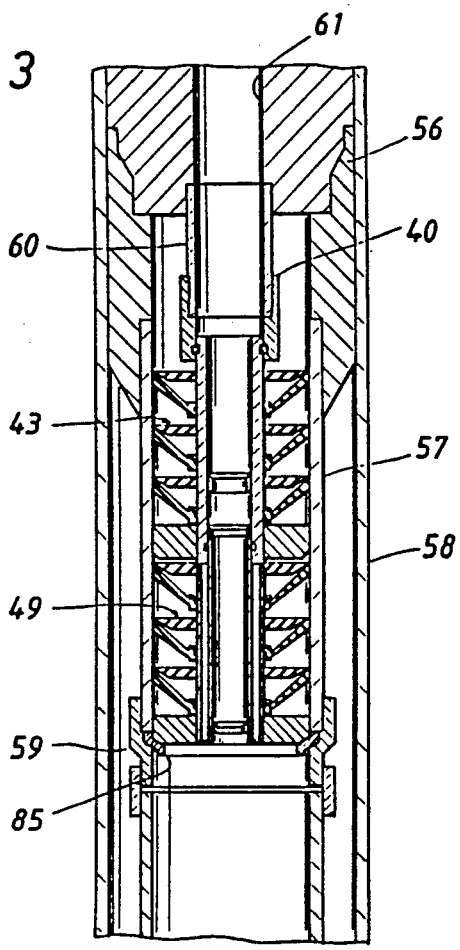
FIG. 3 is cross-section of an alternative embodiment for use in sub sea launching of plug.

FIG. 3 shows an alternative embodiment of a plug launcher in accordance with the present invention and adapted for use in a subsea environment. A casing hanger 56 supports the casing string 57 that is to be cemented within an outer casing string 58. A restriction sleeve 59 which is coupled in the casing string 57 is provided for landing and locating the interconnected displacement plugs 43, 49. Although various restriction subs or sleeves can be used, several embodiments are disclosed and claimed in my U.S. Pat. No. 4,907,689 issued Mar. 13, 1990, which is incorporated herein by reference. The upper and lower displacement plugs 43, 49 and the adapter sleeve 40 for the subsea embodiment are identical to the surface embodiment illustrated in FIG. 2. A mandrel 60 connects the apparatus to the running string 61 that is utilized for the subsea system.

Figure 8:
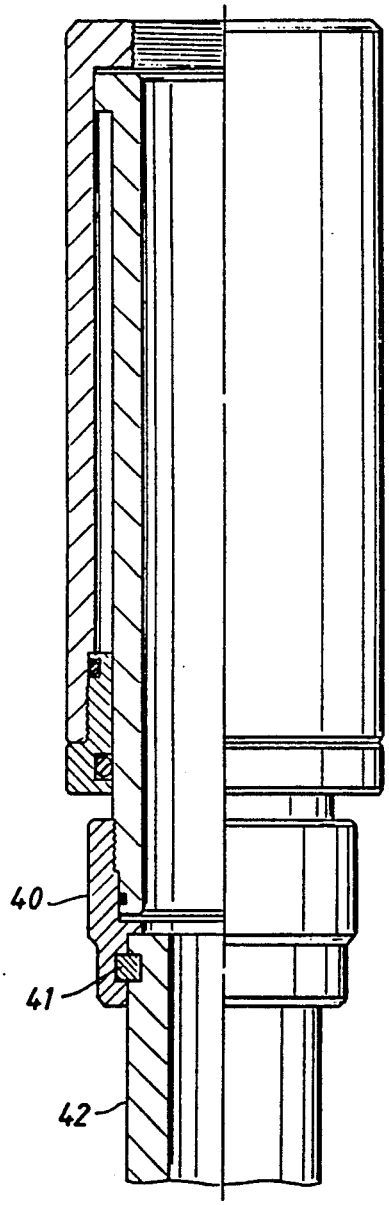
FIG. 8 is a view partly in sections and partly in elevation of a slip-joint used in multiple plug launching applications.

The upper and lower plug assemblies 43, 49 can be used in combination with a slip joint of the type illustrated in FIG. 8. The mandrel 42 of the upper plug 43 is connected by a shear ring 41 to the mandrel of the slip joint as shown, and the lower plug 49 rests or lands in the restriction sleeve 59, 85 as illustrated in FIG. 3. The housing of the slip joint is connected to the adapter 61 by a suitable nipple, and the relative movement allowed by the slip joint is useful in spacing out the components.

Figure 6:
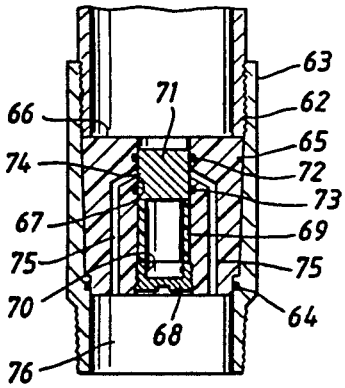
FIG. 6 is a cross-sectional view of a new and improved float collar.

Turning now to FIG. 6, a new and improved float collar is illustrated. Although the present invention can be used with a conventional float collar, applicant would prefer to use the device illustrated. An upper casing 62 is connected to the upper end of a tubular body 63 by standard threads. The inner bore of the body 63 tapers downward and inward to a stop shoulder, and a seal 64 is positioned as illustrated to prevent fluid leakage. A generally frusto-conical plastic insert 65 is formed to seat in the tapered bore of the body 63, and the lower portion thereof engages the seal 64. The lower end face of the upper casing 62 can engage plastic insert 65 and retain and forcefully seat it within the body 63. The insert 65 has a cylindrical bore 67 that receives a piston member 71. Seals 72 and 73, which are located above and below side ports 74 that lead to vertical passages 75 in the insert 65 cooperate with the member 71 to normally close the passages 74, 75. A nut 68 is threaded into and seals the lower end of the bore 67. A spring, preferably non-metallic resilient sleeve 69 is located between the nut 68 and the piston member 71 in a manner such that in its unstressed state, the spring holds the piston 71 in the upper position where it closes off the ports 74 to fluid flow. The piston 71 remains in the upper position until a pressure differential is imposed across it that is sufficient to axially foreshorten the spring 69 by enough that the upper seal ring 72 is uncovered. So long as the pressure force is great enough, the piston will remain open.

Figure 7:
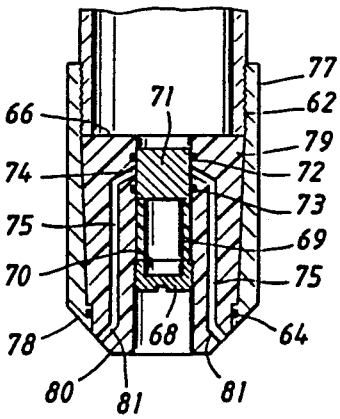
FIG. 7 is a cross-sectional view of a new and improved cementing casing shoe.

FIG. 7 illustrates a new and improved cementing casing shoe that has certain components that are interchangeable with those of the float collar shown in FIG. 6. The shoe body 77, which is formed at its lower extremity 78 so as to provide a conical form, receives a plastic insert 79 whose lower end 80 is formed to continue the conical shape of the lower end of the body 77. The insert 79 has flow passages 75 that are inclined at 81 to enhance a jetting action while fluids are being circulating in the casing that aide in running the string into a borehole. The remaining interior components of the cementing shoe are the threaded retainer plug 68, the tubular elastomer spring 69, the valve member 71, and the upper and lower seals 72, 73. These elements can be interchanged with like elements of the float collar.

The float collar shown in FIG. 6 is designed to withstand the loading applied while pressure testing the casing string after a cement displacement is completed. It preferably is fabricated from high tensile strength plastic, and the tapered landing surfaces improve the loading characteristics. The sliding piston 71 that is closed by the tubular rubber spring 69 is considered to be far superior to prior devices such as ball check valves. When the surface pumps are stopped, the piston 71 is returned to its upper or closed position by the spring 69 to give a positive closure. The present invention is highly resistant to leakage caused by large particles of debris that might lodge between a ball and its seat. The float shoe illustrated in FIG. 7 embodies similar concepts to the float collar, with the exception of having inclined jet ports 81 at the nose of the shoe which enhance a jetting action.

Figure 9:
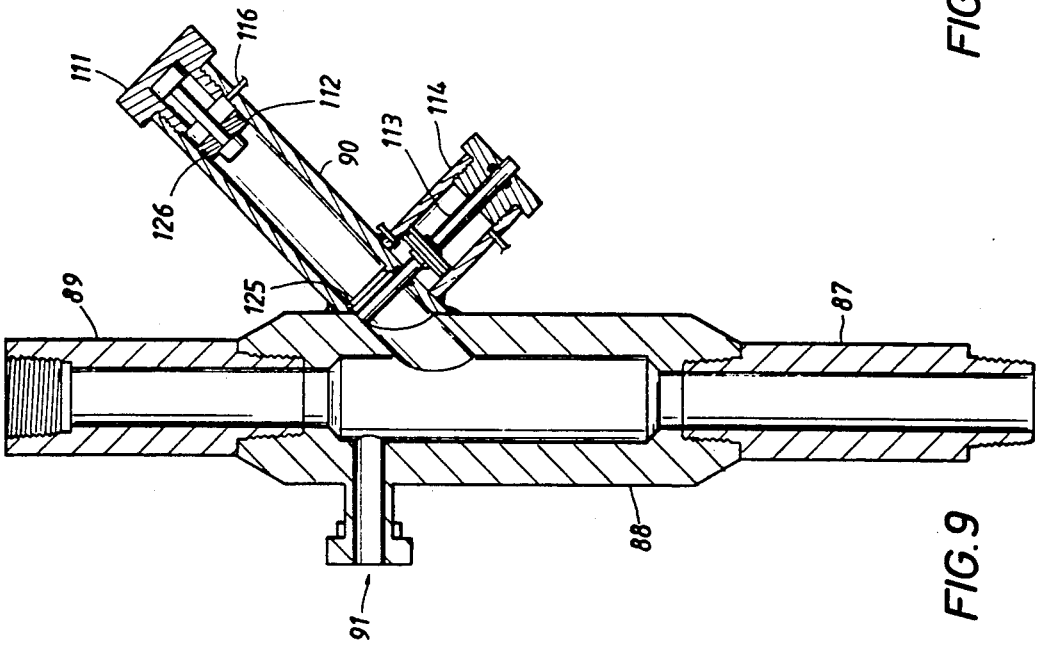
FIG. 9 is a cross-section view of a plug launching tool that can be suspended below rig elevators for cementing casing or liner strings where rotation is not acquired.

FIG. 9 illustrates an alternative embodiment of a launching system in accordance with the concepts of the present invention. This embodiment permits launching a ball or a dart with an apparatus that is suspended below the elevators of a drilling rig. The launching system is designed to launch a ball or a dart while setting balanced cement plugs and cementing casing or liner strings where rotation of the pipe is not required. The apparatus includes top and bottom subs 89 and 87, a tubular body 88, a pair of launch tubes 90 located at 90° to one another (only one shown), and a fluid inlet 91. In the event the rig is equipped with a top drive, the upper sub 89 can be attached to the top drive sub. Otherwise the apparatus can be suspended below the rig elevators by using a drill pile handling sub that is connected to the sub 89. Each cylinder 90 houses a piston 112 that shifts down adjacent a stop 125 when fluid pressure is applied via a port 116. A plunger 126 extends through the piston 112 and is adapted to engage the ball or dart. A cylinder 19 that is attached at a right angle to the cylinder 90 receives a rod 113 having a piston thereon. The inner end of the rod 113 extends through a seal ring and into the bore of the cylinder 90. The opposite end of the rod extends through a seal ring in a cap that closes the outer end of the cylinder 90. Hydraulic ports 117, 118 are provided for selective application of fluid pressure to the opposite sides of the piston. While the rod is in the inner position, the ball is blocked; however, once the rod is shifted outward, the ball can move into the bore of the body 88 below the inlet 91.

Figure 10A:
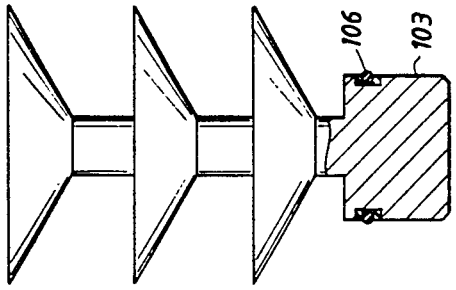
FIG. 10A is a schematic illustration of a dart that can be used to launch the upper plug of FIG. 10.
Figure 10B:
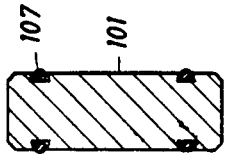
FIG. 10B is a schematic view of a pump down bomb that can be used to launch the lower plug of FIG. 10.
Figure 10:
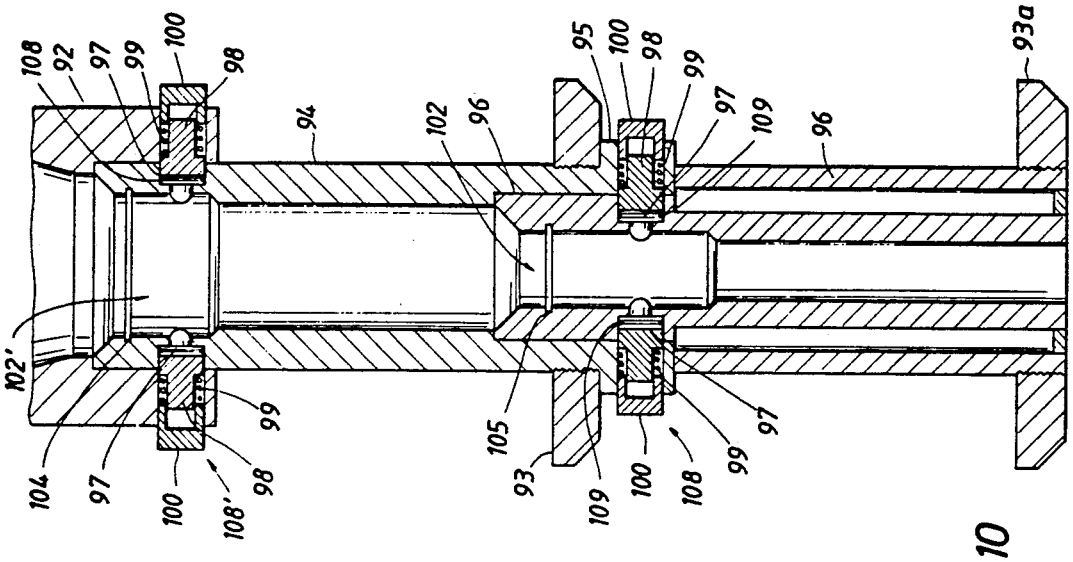
FIG. 10 is a cross-section view of an alternative embodiment of cement plug mandrels.

Referring next to FIGS. 10, 10A and 10B, another embodiment of releasably connected cement plugs that are constructed in accordance with the present invention is illustrated. Hereagain, only the mandrel assemblies are shown, and the upper and lower sets of cup-type seal elements shown in FIGS. 4 and 5 are mounted on the respective mandrels, but are not shown in FIG. 10 for convenience. These plugs can be used in both subsea and platform or land based systems. The upper mandrel 90 is releasably connected by a sleeve 92 to an adapter ring 32 as illustrated in FIG. 2. This permits the plug assembly 92 to be adapted to various plug launching systems. A drive plate 93 is secured to the lower portion of the upper mandrel 94, and another drive plate **93*a* is secured to the lower end of the lower mandrel 96. The lower mandrel 96 is reasonably attached to the upper mandrel 94 by a mechanism indicated generally at 108. A set of at least one, and preferably two radially aligned pairs of bores are formed in the lower end portion of the mandrel 90 and in the upper portion of the lower mandrel 96. The bores each receive a combination of a release pin 97 and a plunger 98 that is biased inward by a coil spring 99. Each outer bore is closed by a threaded cap 100, and a shoulder in the inner bore limits inward movement of the pins 97 and the plungers 98. An o-ring 109 is provided on each release pin 97 to prevent fluids in the mandrel from getting into the spring areas. The springs 99 have high enough rates to prevent premature release in response to circulating fluid pressure. In the position shown in FIG. 10, the inner portion of each plunger 98 spans or extends across the opposed peripheral surfaces of the overlapped mandrel portions so as to couple the mandrels together. The upper portion of the upper mandrel 94 and the overlapped lower portion of the adapter sleeve 92 are releasably coupled by assemblies 108'** in the same manner, and the corresponding elements therefore are given the same reference numbers.

The release pin assembles 108 and 108' are uniquely arranged so that the upper plug cannot be released simultaneously with the lower plug. One way to release the lower plug first is to drop the releasing bomb 101 shown in FIG. 10B which lands in the throat 102 of the lower plug mandrel 96. The o.d. of the bomb 101 is too small for it to seal in the throat at the upper end of the mandrel 91. As the device 101 enters the lower throat 102, its outer surface shifts the pins 97 outward against the bias of the springs 99 to align the respective rear and front surfaces of the pins and plungers with the confronting peripheral surfaces of the mandrels 96 and 94. When this occurs the lower plug assembly 108 is released from the upper plug assembly 108' so that it can travel downward in the casing. To release the upper plug assembly 108' from the sleeve 92, the dart shown schematically in FIG. 10A is pumped downward and landed in the seat 102' at the upper end portion of the mandrel 94. The nose 103 pushes the release pins 97 outward to achieve release in the same manner described above. Grooves 104 and 105 can be formed in the upper and lower mandrels as shown and arranged to receive means such as '0' rings 105 and 107 on the respective bomb and dart noses to releasably hold these members within the respective seats and thereby prevent them from accidentally coming out while displacing cement.

Figure 16:
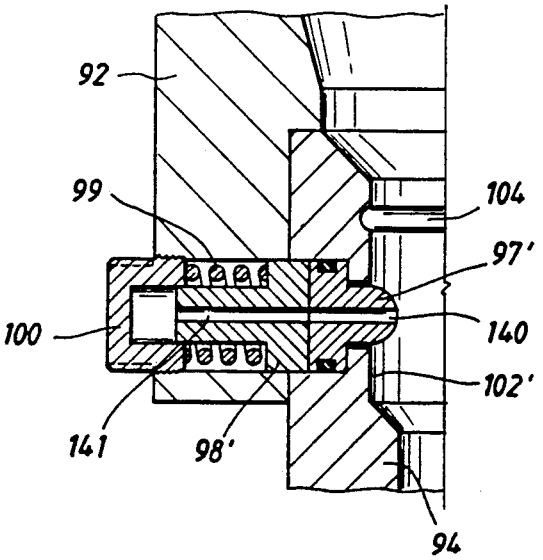
FIG. 16 is an enlarged fragmentary view of alternate embodiment of the release pin arrangement.

Another embodiment of a releasing pin assembly is shown in the enlarged and fragmentary FIG. 16. To prevent all possibility of premature release, each pin 97' and its associated plunger 98' is provided with axially aligned pressure balancing ports 140 and 141. Any fluid pressure in the mandrel 96 acts with equal force in opposite radial directions on the pin and its plunger. Thus, the only way in which a pin 97' can be shifted outward is by imposing a radially outward mechanical force on its nose that exceeds the bias force of the coil spring. As the pins and plungers move outward, fluid in the spring region is transferred to the mandrel bore, and vice versa.

Referring now to FIGS. 11-14, there is shown in detail an injection apparatus which can be used on liners and casing strings set from fixed platforms where rotation and/or reciprocation of the casing or liner may be required. This combination swivel and injector system allows balls and darts to be injected and the pipe string to be rotated, and also allows injection by remote control, thereby providing significantly enhanced safety for workers. Of course the apparatus also can be used in non-rotating operations like the apparatus illustrated in FIG. 9. It should be recognized that more and more operators are rotating the pipe while cementing, especially when cementing liners. Casing strings that are run from floating drilling vessels usually are landed in subsea wellheads and locked in place, which eliminates the use of rotation and reciprocation.

In some prior systems, a dart was run in place below the elevators so that it was not possible to circulate through a top drive. Where circulation was necessary, the top drive connection from the elevators on down were set up without a cement plug or a pump down dart in place until all circulation was completed. Then personnel were sent into the derrick to physically open unions, disconnect flexible hoses, and in general disassemble the entire system in order to position a ball for launching.

The injector swivel shown in FIGS. 11-15 includes a tubular body 128 leaving upper and lower subs 115 and 131 extending into its opposite ends. A fluid inlet 110 communicates with the bore 27 of the body 128. Two cylinders 90 that are spaced or oriented for example, at 90° from one another, are attached to the sides of the body 128 and preferably incline upward and outward. Each of the cylinders 90 will function to launch balls, bombs or darts. The fluid inlet 110 provides a means of communicating with the cementing or circulating manifold which normally is connected thereto by a steel or reinforced rubber flexible hose. The upper sub 115 can have, for example, a 4½ inch internal flush joint connection at its upper end and is joined to the top drive of the rig to allow a second means of fluid circulation. The balls and darts are injected into the bore 127 in response to manipulation of a hydraulic power source that is located on or near the rig floor. A plurality hydraulic lines are connected between the power source and each of the cylinders 90 in order to operate the same from a remote location. Thus personnel are not required to go near the system during any part of its operation.

The cylinder 90 has a threaded cap 111 on its outer end that can be removed in order to position a ball or dart therein. A piston 112 is positioned in the bore of the cylinder 90, and carries a pusher rod 126. These elements also are removable once the cap 111 is removed. A pressure port 116 allows hydraulic pressure to be applied to the outer face of the piston 112 to drive the piston and pusher rod 126 downward until the piston 112 is stopped by a shoulder 125, after which the plunger can continue to move for a limited distance. The piston 112 carries inner and outer seal rings that prevent leakage past the piston or the plunger rod. A gate mechanism for the ball or dart includes another cylinder 114 that is secured at a right angle to the cylinder 90 near the inner end thereof. A cap closes the outer end of the cylinder 114. A rod 113 that carries a piston 113' extends axially of the cylinder 114 and the cap, and through a seal ring at the inner end of the cylinder, in a manner such that the inner end portion of the rod extends across the bore of the cylinder 90. Hydraulic line connections 117 and 118 provide fluid communication to the opposite sides of the piston 113'.

Figure 11:
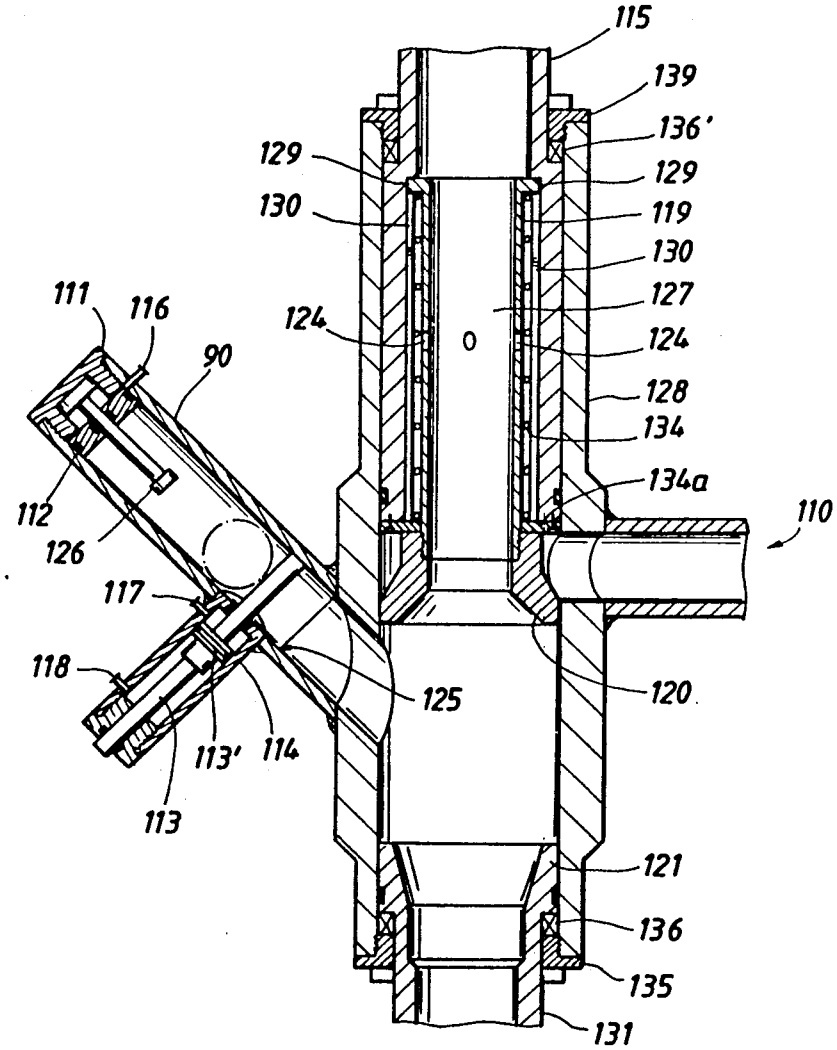
FIG. 11 is a cross-section of a plug or ball launching swivel.

A ball or dart that is positioned in the cylinder sleeve 90 as shown in phantom lines in FIG. 11 is stopped by the inner end section of the piston rod 113. The injector piston 112 and the pusher 126 are located at the outer end of the cylinder 90. The cap 111 is screwed into the top of the cylinder 90 to close it. The other injector cylinder is loaded in the same manner, but with a ball of a different diameter. Of course, one of the cylinders 90 can contain a ball while the other cylinder contains a dart, particularly when using the type of cement plug combination shown in FIGS. 10, 10A and 10B.

The lower sub 131 is suspended from the lower end of the body 128 by a retainer ring 135 and a bearing 136 that is positioned below a shoulder 121 on the upper end of the sub. A suitable seal ring prevents fluid leakage. The upper drive sub 115 extends down into the upper portion of the body 128, and has an external shoulder that engages below another bearing 136' that is held by a threaded ring 139. A seal ring near the lower end of the sub 115 prevents fluid leakage between it and the body 128. A sleeve 119 that is biased upward by a coil spring 134 can move within the body 128 between an upper position shown in FIG. 11 and a lower position shown in FIG. 12. A spider 129 at the upper end of the sleeve 119 has splines as shown in FIG. 13 that mesh with internal grooves 130 on the sub 115, whereby rotation of the sub relative to the body 128 causes corresponding rotation of the sleeve.

Figure 12:
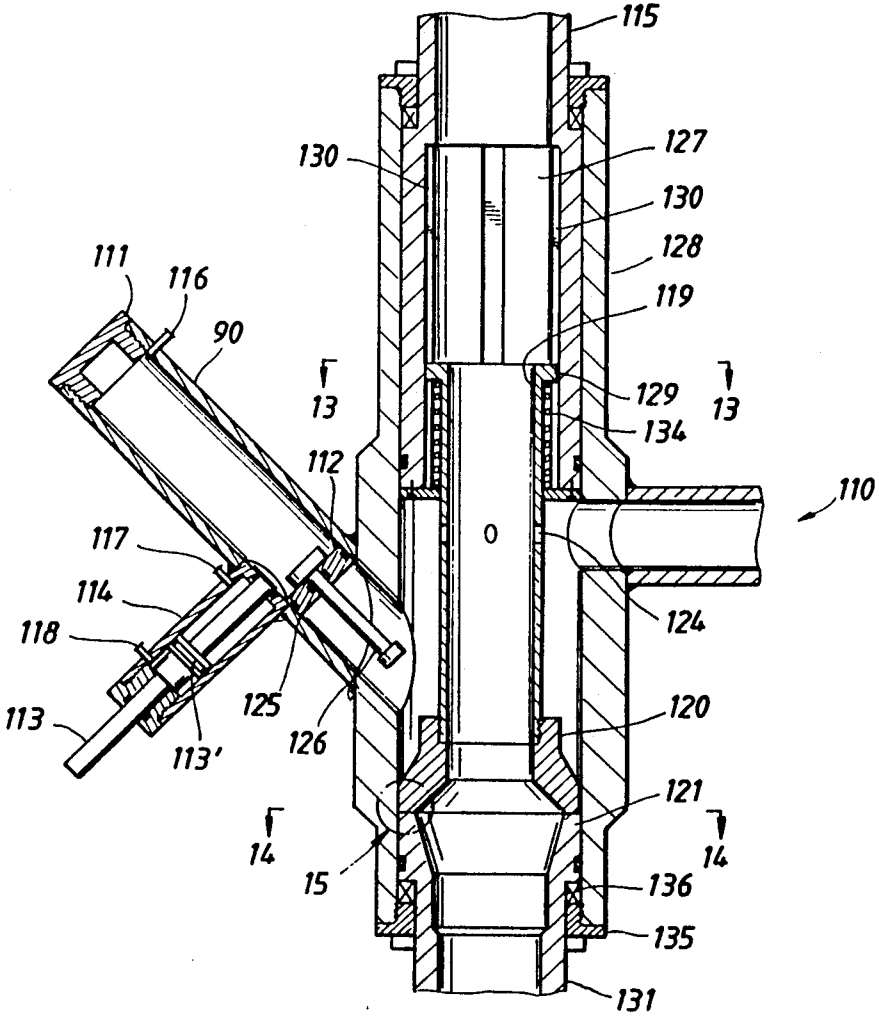
FIG. 12 is a view similar to FIG. 11 but shows the drive sleeve engaged to transmit rotation.
Figure 13:
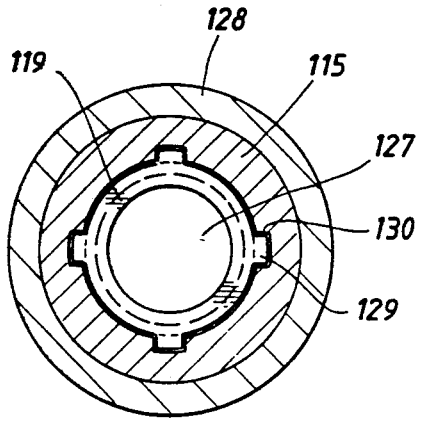
FIG. 13 and 14 are cross-sections on lines 13—13 and 14—14 of FIG. 12.
Figure 14:
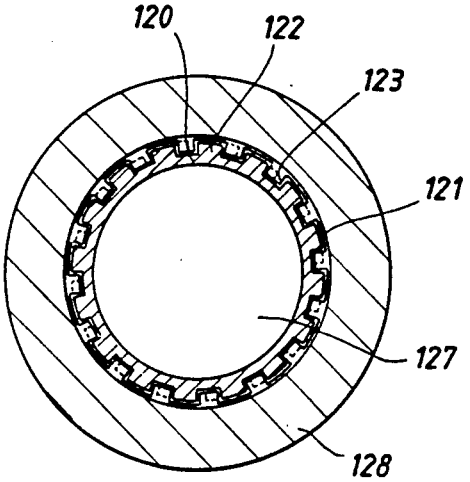
Figure 15:
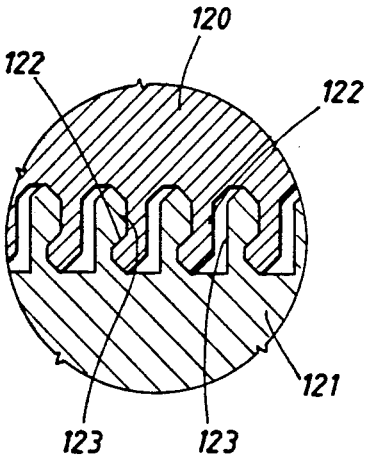
FIG. 15 is an enlarged fragmentary view of releasable drive teeth shown schematically in FIG. 12.

The lower end of the sleeve 119 is connected to a clutch plate 120 that moves down against the upper end of the shoulder 121 when the parts are in the relative positions shown in FIG. 12. In this position, an interlock mechanism on the opposed end faces of the plate 120 and the shoulder 121, as shown in FIG. 15, automatically engages to transmit rotation of the sleeve 119 to the lower sub 131. The mechanism includes teeth 122 on the plate 120 that snap into interlocking engagement with teeth 123 on the shoulder 121 as the two faces come together, the teeth have relatively short accurate forms terminated by radial shoulders. Thus the teeth can be released by a part turn of relative rotation in a direction opposite to the direction of driving engagement. During disconnection, the lower sub 131 is held against rotation by the substantial weight and friction of the pipe string suspended thereby. A plurality of flow ports 124 are positioned to be in general alignment with the inlet port 110 when the sleeve 119 is in its lower position. The elevator handling sub can be threaded into the top of the upper drive sub 115, and the connections made up with tongs, as with a conventional liner cementing swivel.

The crew can run the desired length of liner, and space out with the desired length of drill pipe. The injector swivel assembly then is picked up and the handling sub suspended from the elevators. The hydraulic hose bundle from the hydraulic power unit on the rig is connected to the various connectors 116, 117, and 118. Hydraulic pressure is applied to connectors 118 to position the extension rods 113 in the inner closed positions, and the balls or darts are loaded into the cylinders 90 as described above. The circulating/cementing hose then is attached to a union on the fluid inlet 110, and the drive sub 131 is coupled in the liner landing string.

When the mud pump is started, fluid will pass through the fluid inlet 110 and drive the sleeve 119 downward to lock the clutch plate 120 to the shoulder 121. The ports 124 are sized to provide a substantial back pressure, so that a pressure differential is developed in the downward director across the clutch plate 120 to cause downward movement of the sleeve 119 to the position shown in FIG. 12. Once the upper and lower subs 115 and 131 are coupled as described, rotation of the casing or liner string is possible while the injector body 120 remains stationery.

In order to inject a ball, bomb or dart into the flow stream, the clutch plate 120 is disengaged by relative rotation, and the sleeve 119 will be shifted upward to the position shown in FIG. 11 by the spring 134. Hydraulic pressure then is applied to the inlet port 117 of the cylinder 114. The rod 113 and the piston 113' will shift downward to the open position. Pressure now is applied to the connection 116 to cause the piston 112 and the plunger 126 to launch the ball into the bore 127 of the body 128. The piston 112 stops when it reaches the shoulder 125. The pusher 126 will continue to travel downward a short distance to ensure that the ball is forced out into the passage 127. Circulation of fluid by the mud pump will carry the ball down to the liner where it will engage a companion seat so that hydraulic pressure can be used to set the liner hanger.

Cement slurry is mixed and pumped down the liner running string as described previously. A dart used to follow the cement down the drill pipe where it will pick up a prepositioned wiper plug is located in the other one of the injection cylinders 90. This device is launched in the exact same manner as the ball, and is pumped down to the liner by the rig pump. There the dart picks up the liner displacement plug after the column of cement has passed by as it is displaced from inside the liner to the annulus outside. When the plug reaches the float shoe and stops, the displacement is complete without over or under displacement.

With the above system it is possible to rotate the liner string at any time while circulating and cementing. Rotation is transmitted through drive sub 15 to the sleeve 119 by the splines 129, 130, and through the clutch plate 120 to the lower sub 131 by the engaged teeth. The clutch plate 120 can be engaged for rotational purposes, and disengaged for launching purposes, as desired. Any time that pumping is stopped and the sleeve is rotated a part turn in the opposite direction, the teeth 122, 123 disengage and the spring 134 forces the sleeve 119 to its upper position.

The injector body 128 remains stationary during all operations. Both of the launching cylinders 90, and the fluid inlet 110, are welded to the body 128 as shown. The weight of the casing or liner is supported by the lower thrust bearing 136 and the lower retainer ring 135.

OPERATION OF THE VARIOUS EMBODIMENTS

In operation, the injection manifold 1 of FIG. 1 is mounted on a frame 4 and placed on or near the rig floor. The inlet end 5 of the manifold is connected to a cement manifold. The opposite end 7 of the injection manifold 1 is connected by a high pressure hose to the inlet fitting 35 of the plug launching system. To load the balls 82 into the injection manifold, the caps 16 are removed from the housings 8 and 9 and the pick-up balls 2 and 3 are placed in the ball housings 8 and 9. The pick-up ball utilized with the bottom plug 49 is slightly smaller in diameter than the pick-up ball 3 that seats in the top plug 43. The balls 2 and 3 initially rest on top of the inner portions of the rods 23, which are held in their inner positions by the springs 21. The caps 16 are reinstalled and tightened and the springs 15 cooperate with the flanges 13 to push the lower end of the rods down against the balls.

The assembled upper and lower plugs 43, 49 are installed in the casing, for example at the top thereof as shown in FIG. 2, by coupling them to the sleeve 90 which is threaded to the casing adapter 32. The adapter 32 is fixed to the member 31 which is threaded to the casing collar 30.

The plug assemblies 43 and 49 can be coupled together as an in-line unit by the shear rings 41 and 48. These rings can be made of a plastic that is injected into the grooves and allowed to set up. The handling sub 36 is threaded into the upper end of the adapter ring 32, and the assembly of the handling sub, the adapter ring, the sleeve 90 and the series of displacement plugs 43 and 49 are lowered into the casing 29. A nut 33 or the like locks the adapter ring 32 rigidly in place at the top of the member 31. The assembly is adaptable to a wide variety of casing sizes by merely providing members 31 which have threads that match a particular casing collar thread. The well can be conditioned, if desired, by circulating an appropriate fluid down the casing and up through annulus outside the casing. The assembled top and bottom plugs 43, 49 which are located within the casing 29 near the surface as shown in FIG. 2, or in a subsea system where it rests against a restriction sub 59 as in FIG. 3, are retained in those positions during the conditioning step.

The pick-up balls 2, 3 are launched by applying air under pressure from a rig pneumatic source to the cylinders 20 through the air inlet means 22. If a mechanical latching means is provided, it must first be released, and then air pressure is applied to the inlet 27 to cause the piston rod 23 to shift outward against the bias of the spring 21. The projecting end portion 25 of a rod 23 is pulled out from underneath a ball 82. When this occurs the spring 15 extends and forces the rod 14 downward, thereby moving a ball 82 through an opening 10 or 11 and into the bore 12 of the manifold. Consequently, a ball will pass through the hose and the inlet 35, and on down to where it: seats in the ring 54 in the lower plug 49. The first ball passes through the upper seat ring 45 due to its smaller diameter. The application of a selected pressure to the ball will shear the lower ring 48, and thereby release the lower displacement plug 49 so that it can move on down the casing 29. At the proper time, the sequence of manipulations is repeated to launch the larger ball 3 so that it comes to rest in the seat 45 in the upper plug 93. Hereagain an increase in pressure will disrupt the upper shear ring 41 and release the upper plug 43.

A magnetic sensor 37 can be placed in the system downstream of the inlet 35 to trigger a light to its "on" position when a ball 82 passes the sensor. A small pencil-size permanent magnet can be implanted in each of the balls 82 as indicated by numeral 82 in FIG. 1. The light provides a visible indication that a ball has passed down into the throat of a plug mandrel. This indication is in addition to the indication of the launching of a pick-up ball given by the physical position of a rod 14 which retracts as launch is achieved.

In the alternative embodiment which utilizes a restriction sub 59 as illustrated in FIG. 3, it is not actually necessary to lock the top and bottom plugs together, since the bottom plug is supported by the restriction sleeve 85. Of course a predetermined pressure differential is required to force the plug through the sleeve.

For the alternative embodiment shown in FIG. 3 which is utilized in subsea cementing operations, the assembly procedure is varied slightly, and one first picks up the handling sub and connects that with a crossover sub to a strand of drill pipe. Then the mandrel adapter is made up to the subsea hanger system and the assembly is stood back in the derrick. Either the interconnected set of displacement plugs, or the set used with a restriction sleeve, can be employed as desired.

The subsea and the other cementing plug systems are launched essentially in the same manner. The desired amount of casing is run, and the casing elevators are changed out for drill pipe elevators. The subsea landing string is run and landed out, or the casing landing pup joint with the handling sub is run and landed out. The balls are launched and are picked up in the respective bottom and top plugs, as described above. The surface injection manifold is placed in position, and the chicksan is connected from a cement manifold to the injection manifold. A high pressure hose is of course attached between the outlet of the injection manifold and the casing handling sub inlet 35. The system can be pressure tested, and then circulated by the rig pump by the desired amount. The smaller pick up ball for the bottom plug mandrel is released by attaching an air line from the rig air supply to the air cylinder. The piston retracts causing the rod to move out of the cylinder.

Then the smaller pick-up ball is launched by extension of the spring 14 and passes through the hose and past the magnetic sensor and into the ball seat 45 on the lower plug 49. Pressure releases the lower plug 49, either by shearing its connecting ring, or by forcing it through the restriction sleeve 85, depending upon which embodiment is being utilized. After a proper amount of cement slurry has been displaced, the top plug is launched in a similar manner by operating the air cylinder to release the larger ball which moves into the flow stream, past the magnetic sensor 37, and into the landing seat 45 of the top plug 47.

The top displacement plug 47 is now displacing the cement. When the bottom plug 49 bumps the float collar, additional pressure acting through the passage 52 ruptures the discs 53 to allow fluid to pass through the circulating ports of the float collar, and on through the circulating ports in the cement shoe. As pressure differential is applied across the pistons of the float collar and cement shoe, each piston is forced downward to open the flow ports to establish circulation.

In order to check or prevent "U-tubing" or back flow of cement when the pump is stopped, and the elastomer springs 69 force the pistons 21 upward, thereby covering the circulating ports and provide a trouble free check value arrangement. The float collar and cement shoe typically are run in the casing string with the float collar located one or two joints above the cement shoe.

To sum up at least some of the advantages of the method and apparatus of the present invention, it should be appreciated that the balls are launched by remote control, thereby eliminating having to send personnel into the derrick for a manual launch. The systems can be utilized on any size casing, simply by changing out the adapter bushing for each casing size and type thread. The system is adaptable to any existing subsea system simply by using an appropriate cross-over adapter. The use of top and bottom displacement plugs gives a more positive seal against the wall of the casing, and the system can included more than two displacement plugs to run optional chemical spacer fluids if desired. The system of the present invention is installed primarily inside the casing, and therefore requires little additional clearance above the casing for housing or plug installation. The plug injection apparatus head of the present invention can be tested to pressures exceeding the internal yield of any casing string with which it is used. The displacement plug sets, comprising two or more plugs which may or not be interlocked by shear rings, can be fabricated mainly from high tensile strength plastic materials, such as polyurethanes and/or rubber. Thus the plugs can be easily drilled out with a suitable bit when the need arises.

While various embodiments of the present invention have been described, it will be recognized and understood that various modifications may be made without departing from the inventive concepts. Thus the appended claims are intended to cover all modifications and changes that fall within the true spirit and scope of the present invention.

What is claimed is:

1. Apparatus for use in launching cementing plugs into a well conduit, comprising: A generally tubular body having a flow passage and upper and lower end portions; upper drive means extending into said upper end portion and arranged for rotation relative thereto; lower drive means extending into said lower end portion and arranged for rotation relative thereto; sleeve means mounted in said body for axial movement between an upper position and a lower position; first means for corotatively coupling said sleeve means to said upper drive means so that rotation of said upper drive means is transmitted to said sleeve means; and releasable clutch means for coupling said sleeve means to said lower drive means in said lower position whereby rotation of upper drive means and said sleeve means is transmitted to said lower drive means when said sleeve means is in said lower position.

2. The apparatus of claim 1 further including inlet means through the wall of said tubular body; and means responsive to the pressure of fluids at said inlet means for moving said sleeve means to said lower position to engage said clutch means.

3. The apparatus of claim 2 further including spring means for moving said sleeve means to said upper position in the absence of flow of fluid through said inlet means.

4. The apparatus of claim 3 further including port means through the wall of said sleeve means, said port means being sized to develop a back pressure to said flow of fluid and being radially aligned with said inlet means in said lower position of said sleeve means.

5. The apparatus of claim 1 further including first cylinder means fixed to said tubular body, said first cylinder means having an internal bore that communicates with said passageway and which is adapted to receive a device that is to be launched into said passageway; and first gate means on said first cylinder means for selectively preventing and permitting movement of said device into said passageway.

6. The apparatus on claim 5 where said first gate means includes a blocking means having a portion extending into said bore of said first cylinder means and movable between extended and retracted positions: and remotely and selectively operable means for actuating said blocking means.

7. The apparatus of claim 6 wherein said first gate means includes second cylinder means fixed at a right angle to said first cylinder means, said blocking means including a piston member arranged for reciprocating movement in said second cylinder means; said actuating means including port means on said second cylinder means for applying selective pressures to said piston member.

8. The apparatus of claim 6 where said first cylinder means has a piston assembly mounted for axial movement therein, said piston assembly being arranged for movement between an outer position where said blocking means portion is in said extended position and an inner position where said blocking means portion is in said retracted position to cause a device loaded in said first cylinder means to be pushed past said portion and into said passageway.

9. The apparatus of claim 8 wherein said piston assembly includes an annular piston member having a plunger rod movable therethrough, said plunger rod being adapted to engage a device and to push said device during movement of said piston assembly to said inner position.

10. The apparatus of claim 9 further including stop means for limiting inward movement of said piston assembly, said plunger rod being arranged for further inward movement a limited distance after said piston member encounters said stop means.

11. The apparatus of claim 5 wherein said first cylinder means inclines upward and outward with respect to the longitudinal axis of said tubular body so as to launch said device downward into paid passageway.

12. The apparatus of claim 5 further including third cylinder means fixed to said tubular body at a predetermined angular orientation relative to said first cylinder means; said third cylinder means having an internal bore that communicates with said passageway; and second gate means on said third cylinder means for selecting preventing and permitting movement of a device loaded therein into said passageway.

13. Apparatus for use in launching a device plug into a well conduit, comprising: a tubular body having a central passageway and means at its opposite ends for connecting said body in pipe string; inlet means through the wall of said body to enable a fluid to be pumped through said passageway; cylinder means attached to said body and inclining upward and outward thereof, said cylinder means being adapted to receive a device that is to be moved into said passageway and down into said pipe string; piston means in said cylinder means movable from an outer position to an inner position therein for moving said device into said passageway; gate means on said cylinder means for permitting and preventing movement of said device; and remotely and selectively operable means for actuating said piston means and said gate means.

14. A plug assembly for use in displacing cement or other fluid in a well conduit, comprising: upper plug means including a first tubular body having flexible seal cup members mounted thereon adapted to drive said first body down a well conduit in response to pressure, said first body having first annular seat means in the bore thereof; and lower plug means adapted to be releasably connected to said upper plug means and including a second tubular body having flexible seal cup members mounted thereon adapted to drive said second body down a well conduit in response to pressure, said second body having second annular seat means in the bore thereof.

15. The assembly of claim 14 further including guide plates on the respective lower ends of said first and second tubular bodies.

16. The assembly of claim 14 wherein said second seat means has an internal dimension that is less than the corresponding internal dimension of said first seat means.

17. The assembly of claim 14 further including means for releasably connecting said second tubular body to said first tubular body.

18. The assembly of claim 14 further including an adapter sleeve; and means for releasably connecting said first tubular body to said adapter sleeve.

19. The assembly of claim 14 wherein said lower plug means includes passage means for bypassing fluids through said cup members externally of the bore of said second tubular body; and differential pressure operated value means for normally closing said passage means, said differential pressure operated value means being adapted to be opened when said lower plug mean encounters a stop in a well conduit.

20. The assembly of claim 14 further including slip joint means connected to the upper end of said first tubular body; and pressure responsive means for releasably connecting said first tubular body to said slip joint means.

21. The assembly of claim 14 further including a plurality of laterally shiftable pin members mounted on said second body and extending into said second seat means; plunger means for holding each of said pin members in said inner positions; and means responsive to outward movement of said pin members an said plunger means for releasing said lower plug means from said upper plug means to enable said lower plug means to travel downward in a well conduit.

22. The assembly of claim 14 further including a plurality of laterally shiftable pin members mounted on said first body and extending into said first seat means, said pin members being moveable radially between inner and outer positions; plunger means for holding each of said pin members in said inner positions; and means responsive to outward movement of said pin members and said plunger means for releasing said upper plug means to enable it to travel downward in a well conduit.

23. The assembly of claim 21 or claim 22 further including spring means for biasing each of said plunger means and pin members toward said inner positions.

24. The assembly of claim 21 or claim 22 further including pressure balance port means extending through each of said pin members and each of said plunger means for balancing pressure forces of opposite sides of each of said pin members.

25. The assembly of claim 22 further including a release member adapted to seat in said second seat means and shift said pin members from said inner to said outer positions and thereby actuate said releasing means.

26. The assembly of claim 22 further including a release member adapted to seat in said first seat means and shift said pin members from said inner to said outer positions and thereby actuate said releasing means.

27. The apparatus of claim 1 where said clutch means comprises downwardly projecting teeth on said sleeve means adapted for interlocking engagement with upwardly projecting teeth on said lower drive means; means for automatically engaging said teeth in response to axial movement of said sleeve means to said lower position; and means for releasing said interlocking engagement in response to relative rotation.

28. A method of injecting an operating device into the passageway of a body having its upper end coupled to an upper pipe member and its lower end coupled to a lower pipe member and allowing rotation of the pipe members relative to said body, comprising the steps of: providing a pressure responsive sleeve that is slidably splined to said upper member for movement between upper and lower positions; biasing said sleeve toward said upper position; applying fluid pressure to said sleeve to shift it to said lower position; automatically coupling said sleeve to said lower pipe member in said lower position to transmit rotation on said upper pipe member to said lower pipe member via said sleeve; and injecting an operating device into said passageway when said sleeve is in said upper position.

29. A method of sequentially launching upper and lower cementing plugs that are releasably connected to one another and to a tubular member above said upper cementing plug, comprising the steps of: providing releasing seats in each of said plugs, said seat in said lower plug having a lesser internal dimension than the seat in said upper plug: pumping a first releasing member through said upper plug and into the releasing seat in said lower plug; releasing said lower plug from said upper plug when said first releasing member seats in said releasing seat on said lower plug to enable said lower plug to move downward in a well conduit ahead of said first plug; pumping a second releasing member into said releasing seat in said upper plug; and releasing said upper plug from said tubular member when said second releasing member seats in said releasing seat in said upper plug to enable said upper plug to move downward in the well conduit.

* * * * *